US006507659B1

(12) United States Patent
Iredale et al.

(10) Patent No.: US 6,507,659 B1
(45) Date of Patent: Jan. 14, 2003

(54) MICROPHONE APPARATUS FOR PRODUCING SIGNALS FOR SURROUND REPRODUCTION

(75) Inventors: John J. Iredale, Novato, CA (US); Roger S. Keller, Berkeley, CA (US)

(73) Assignee: Cascade Audio, Inc., Novato, CA (US)

( * ) Notice: Subject to any disclaimer, the term of this patent is extended or adjusted under 35 U.S.C. 154(b) by 0 days.

(21) Appl. No.: 09/721,136

(22) Filed: Nov. 22, 2000

Related U.S. Application Data

(63) Continuation-in-part of application No. 09/236,511, filed on Jan. 25, 1999, now abandoned.

(51) Int. Cl.[7] ..... H04R 5/00; H04R 3/00
(52) U.S. Cl. ..... 381/26; 381/92; 381/111
(58) Field of Search ..... 381/92, 111–115, 381/26

(56) References Cited

U.S. PATENT DOCUMENTS 4,550,343 A * 10/1985 Nakatani ..... 381/122
4,764,817 A * 8/1988 Blazek et al. ..... 358/341
4,862,278 A * 8/1989 Dann et al. ..... 358/225
4,947,437 A * 8/1990 Firebach ..... 381/26
5,206,910 A * 4/1993 Hamada et al. ..... 381/26
5,361,378 A * 11/1994 Traini, Jr. ..... 381/26
5,386,473 A * 1/1995 Harrison ..... 381/1
5,477,270 A * 12/1995 Park ..... 381/92
5,673,327 A * 9/1997 Julstrom ..... 381/92
5,778,083 A * 7/1998 Godfrey ..... 381/122
6,041,127 A * 3/2000 Elko ..... 381/66

* cited by examiner

*Primary Examiner*—Forester W. Isen
*Assistant Examiner*—Laura A. Grier
(74) *Attorney, Agent, or Firm*—Larry D. Johnson; Craig M. Stainbrook; Johnson & Stainbrook, LLP

(57) ABSTRACT

A microphone apparatus or assembly includes three or more microphone elements supported on a horizontal plane or planes, which microphones are physically arranged and electrically combined such that the resulting composite stereo signals, left total and right total, produce a surround image and are compatible with current standard surround decoders.

18 Claims, 10 Drawing Sheets

MICROPHONE APPARATUS FOR PRODUCING SIGNALS FOR SURROUND REPRODUCTION

CROSS REFERENCE TO RELATED APPLICATIONS

This application is a continuation-in-part of U.S. Application No. 09/236,511, filed Jan. 25, 1999 now abandoned.

FEDERALLY SPONSORED RESEARCH OR DEVELOPMENT

Not applicable.

FIELD OF THE INVENTION

This invention relates to a microphone assembly consisting of three or more microphone elements that are arranged to achieve a surround image for recording audio, especially audio synchronized with video. The outputs of the invention are compatible with current surround decoders.

BACKGROUND OF THE INVENTION

Prior art multiplexing systems for reducing more than two audio channels to two audio channels are replete in the art. Common practice in this area involves encoding a two channel or stereo recording by means of multiplexing in order to establish more than two channels of sound in the two channel recording, which extra channels of sound typically are retrieved by a complementary reversal of the encoding process. The most notable is the system licensed under the trademark DOLBY PROLOGIC. Usually, a recording is encoded with a DOLBY SURROUND SOUND brand system for subsequent playback on a system equipped with a complementary proprietary decoding circuit which extracts so-called "matrixed" information from the recording for playback through left, right, center, and rear speakers. This is a relatively simple process compared to the more complex quadraphonic matrixing systems of past. This proprietary system has grown in popularity due to prominence of encoded source material such as movies having surround sound soundtracks. More importantly, however, the DOLBY PROLOGIC brand decoder, along with the predecessor, the DOLBY SURROUND brand decoder, is compatible with playback of conventional stereo recordings and other sources and can provide pleasant results, especially with recordings having notable ambient content (e.g. recordings produced with a pair of microphones, one corresponding to one of the two stereo channels in the recording). This proprietary decoding process produces four channels of sound from the two channel input of a stereo recording or other source: Left, Right, Center, and Surround. The DOLBY standard includes additional parameters and specifications for the encode/decode process, such as bandwidth filters and delay, but it can be seen that decoding essentially consists of summing the Left and Right channels of stereo recording to produce the third "Center" channel, and subtracting the Left channel information from the Right channel information to derive the fourth "Surround" channel. The Surround channel thus essentially consists of information which is inherently out of phase between the Left and Right channels (i.e. generally a difference of 180 degrees). This encoding process makes use of the natural ability of the ear to perceive out-of-phase audio information to artificially create the Surround channel and store it as ambient or out-of-phase information on the Left and Right channels. Naturally, any out-of-phase or ambient information contained on a conventional stereo recording, such as a stereo recording of an orchestra, is also extracted by such a prior art decoder during playback and accordingly reproduced as "surround" channel information, but not to any discernable degree, due to lack of strength of the out-of-phase signal. Similarly, "center" channel information contained on a conventional stereo recording or other source may be exaggerated when decoded during playback with this system's decoder due to excessive center stage content contained in the conventional stereo recording.

Many microphone assemblies are known for monophonic and stereophonic recording, which assemblies can include a single or pair of microphone elements. Such prior art microphone assemblies are limited in their ability to reproduce a full, two dimensional sound field and in their ability to localize sound. While other microphone assemblies with more than two microphone elements can reproduce relatively full, two dimensional sound fields and can localize sounds, their outputs are not compatible with standard surround decoders. Also, they are deficient in their ability to reproduce what may be called a staging effect or surround image, which would be compatible with DOLBY SURROUND technology.

There is a need, therefore, for a microphone apparatus which can cheaply and reliably produce a surround image (as defined below), localize sounds and remain compatible with standard surround decoders.

Prior developments in this field may be generally illustrated by reference to the following U.S. Patent documents:

U.S. Patent Documents

| Patent No. | Patentee | Issue Date |
|---|---|---|
| 4,206,324 | Horikawa et al. | Jun. 3, 1980 |
| 4,262,170 | Bauer | Apr. 14, 1981 |
| 3,872,249 | Takahashi et al. | Mar. 18, 1975 |
| 4,072,821 | Bauer | Feb. 7, 1978 |
| 3,845,245 | Takahashi | Oct. 29, 1974 |
| 4,680,796 | Blackmer et al. | Jul. 14, 1987 |
| 5,027,403 | Short et al. | Jun. 25, 1991 |
| 4,841,573 | Fujita | Jun. 20, 1989 |
| 3,856,992 | Cooper | Dec. 24, 1974 |
| 4,947,437 | Firebaugh | Aug. 7, 1990 |

The disclosures of the above patent documents are incorporated herein by reference.

U.S. Pat. No. 3,872,249 shows a circuit for decoding an encoded or matrixed signal on a stereo channel (i.e. Left and Right channels) based on a known variable mixing ratio for matrixing at least four sound channels (i.e., Left Front, Right Front, Left Rear, and Right Rear). Passing similarity with the present invention lies in the general teaching of matrixing more than two channels into a two channel medium. In the case of the instant invention, however, no forced phase shifting (i.e. by use of electronics) occurs, as it does in this reference. Also, a multi-channel recording device, along with a multi-channel mixer, generally are required to produce an acceptable multi-channel recording in this reference.

U.S. Pat. No. 4,206,324 discloses a multi-element microphone assembly in which two microphone side element supports are pivotally disposed relative to a center fixed element support. The side supports are pivotally adjustable relative to the center fixed element, and the output levels of the side elements are electrically adjustable relative to the center element output. This reference does not show a rear microphone element, nor a matrixing circuit for four microphone elements.

U.S. Pat. No. 4,262,170 teaches a microphone system and circuitry for encoding multi-channel sound information picked up by its microphones into two channels (i.e. Left and Right) for subsequent playback by an SQ type quadraphonic sound system. Similarity with the present invention lies in the general teaching of a microphone apparatus and circuitry for encoding multiple channels into two channels, but the reference teaches subsequent playback on a system with complementary decoding. The actual circuit itself in one embodiment relies on signal phase shifting and amplification to encode the multiple channels, whereas the present circuit relies on signal amplification only. Other embodiments of this reference show various frequency-dependent phase-shifting and amplitude-adjusting circuits. The system of the present invention inherently incorporates natural phase shift in that information received by the rear microphone hereof generally is out-of-phase with the center microphone, in relation to the recording site. This reference further notes that Neuman Company of West Berlin, Germany, manufactures a 4-element adjustable microphone assembly.

U.S. Pat. No. 4,947,437 to Firebaugh teaches the use of a four-quadrant photoelectric microphone to produce unencoded stereo signals, which signals (apart from their creation by photoelectrically measuring acoustical displacement of a suspended ball at a single point in space) are entirely conventional stereo. That is to say, only combined center/left and combined center/right audio information is passed on to the left and right output signals, the rear audio information being subtracted out. The Firebaugh device does not encode and preserve surround information, as defined infra. A missing feature in Firebaugh (and other art) is the orientation of the microphone elements as related to 4-2-4 matrix inputs, which is required to acoustically capture the sound local to a camera in a way that when encoded with the 4-2-4 matrix produces a signal compatible with DOLBY SURROUND brand decoder technology. In addition, Firebaugh teaches elements that are equally sensitive throughout their entire area, lacking axial directions of maximum sensitivity.

Conventional stereo has an attribute known as stereo image, which is defined as the separation of a sound field into two regions, left and right. Dolby stereo has an attribute known as surround image, which is defined as the separation of a sound field into four regions, left, right, center, and rear. The surround image of this invention is created by the orientation of the four microphone elements in combination with the relative weighting of the four microphone signals, to achieve the surround image in a Dolby stereo signal.

SUMMARY OF THE INVENTION

A "surround image" is defined for the purposes of the present invention as the orientation of four microphone elements so as to section the acoustic environment to be recorded into four regions that capture the main features of a stage environment (the environment of, for example, a live play produced on the stage of a commercial theater). These regions are labeled stage left (or left), stage right (or right), center stage (or center), and ambient (or rear). As has been shown in the theater industry and the commercial movie industry, this sectioning of the acoustic environment creates the most realistic sound from the point of view of the listener. Very likely, this is due to the familiarity of listeners with live entertainment, conventionally viewed and heard in real-life stage environments.

The microphone system of this invention differs from all other microphone systems by employing, and faithfully receiving for realistic reproduction, a surround image. FIG. 7 shows the orientation of the four microphone elements of this invention and how they appear in the acoustic environment in order to create this surround image.

Current electronic technology dictates that audio signals be transmitted and stored in a stereo format. For this reason, the four microphone element signals are encoded into stereo using the circuitry means shown in FIGS. 5 and 6.

Current commercial electronics technology also utilizes a standard method of two to four channel decoding, known under the trademark DOLBY SURROUND SOUND. The microphone apparatus described is completely compatible with this decoding method.

When this invention is compared to the prior art, for example, U.S. Pat. No. 4,262,170 to Bauer, it can be seen that the latter is comprised of a microphone with a separate chassis that houses extensive encoding circuitry. The present invention is comprised of a microphone assembly only, with a simple encoding scheme built in. The Bauer device works only with a complementary decoder by the same inventor, while the present invention works with standard industry decoders, without modification. One example of such a standard industry decoder is the Kenwood Audio/Video Surround Receiver, Model #107VR, available from Kenwood USA of Long Beach, Calif. The Bauer device attempts a three dimensional representation of the ambient acoustical environment, while the present invention creates a surround image similar to that used in cinema and the like (i.e., stereo with a monaural center channel and a monaural surround channel). While, as noted above, surround imaging is a somewhat artificial convention, the surround image effect is familiar to audiences, and therefore may be even more acceptable to them psychologically and physiologically than three dimensional sound.

Alternatively, the present invention may be understood as eliminating the need for DOLBY brand encoding or mixing during the production of a conventional two channel recording by providing an improved microphone assembly capable of capturing additional natural ambient information and distinguishing natural center and rear information that is present during recording. The stereo audio information from the microphone then requires only two channels of a recording device for recording.

An alternative implementation of this invention uses just three microphone elements. With the center channel microphone element eliminated, a virtual center channel is present at output Left and Right. This is due to the fact that the acoustical energy from stage center reaches the left and right microphone elements at the same time, thus creating a mono, i.e. center, signal at outputs LT and RT.

A further additional implementation uses a fifth microphone element as a second rear channel, analog to digital conversion, DSP processing and AES output to achieve compatibility with Dolby Digital 5.1 format.

FEATURES AND ADVANTAGES

It is the primary object of the invention to provide a microphone assembly utilizing a microphone array and an encoding circuit for producing a stereo composite signal equivalent to that required by movie and video industry surround decoders.

It is a further object of the invention to provide an improved microphone assembly which is free from the limitations of the prior art and which provides a surround image and localization of recorded sound.

It is a further object to of the invention to provide a microphone assembly including four microphones in which output signals from the microphones are combined into a surround stereo left and right composite signal.

It is a further object of the invention to provide a microphone assembly including four microphone elements which can take the form of a stand-alone microphone assembly.

It is a further object of the invention to provide a microphone assembly which is designed to attach externally to a video recording camera.

It is a further object of the invention to provide a microphone assembly which is integrated within a video recording camera body.

Another feature is an apparatus that is easy to use, attractive in appearance and suitable for mass production at relatively low cost.

Other novel features which are characteristic of the invention, as to organization and method of operation, together with further objects and advantages thereof will be better understood from the following description considered in connection with the accompanying drawing, in which a preferred embodiment of the invention is illustrated by way of example. It is to be expressly understood, however, that the drawing is for illustration and description only and is not intended as a definition of the limits of the invention.

Certain terminology and derivations thereof may be used in the following description for convenience in reference only, and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted.

Figure 1:
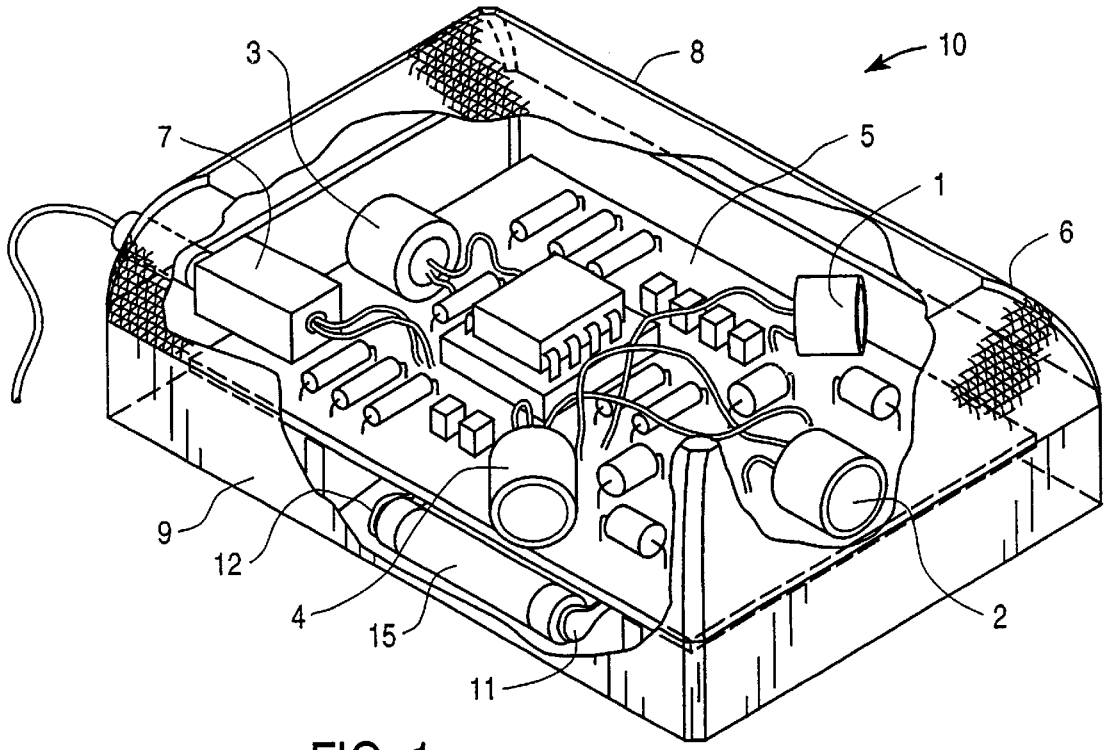
FIG. 1 is a cut-away orthographic view of the first preferred embodiment of the invention, which shows a microphone apparatus in a stand-alone version.

It is to be noted that, for convenience, the last two positions of the reference numerals of alternative embodiments of the invention duplicate those of the numerals of the embodiment of FIG. 1, where reference is made to similar or corresponding parts. However, it should not be concluded merely from this numbering convention that similarly numbered parts are equivalents.

DETAILED DESCRIPTION OF THE INVENTION

FIG. 1 illustrates a microphone apparatus 10 comprising a first preferred embodiment of this invention. It shows a circuit board 5 mounted within a housing 6 comprised of a cover 8 and a base 9. Also mounted within said housing is a battery 15, connecting wires, such as wires 11 and 12, and the appropriate fastening hardware. Output from the microphone apparatus 10 is taken from a jack or jacks 7. Alternatively, the device may have its own external cord for connecting the device to compatible audio equipment.

Figure 2:
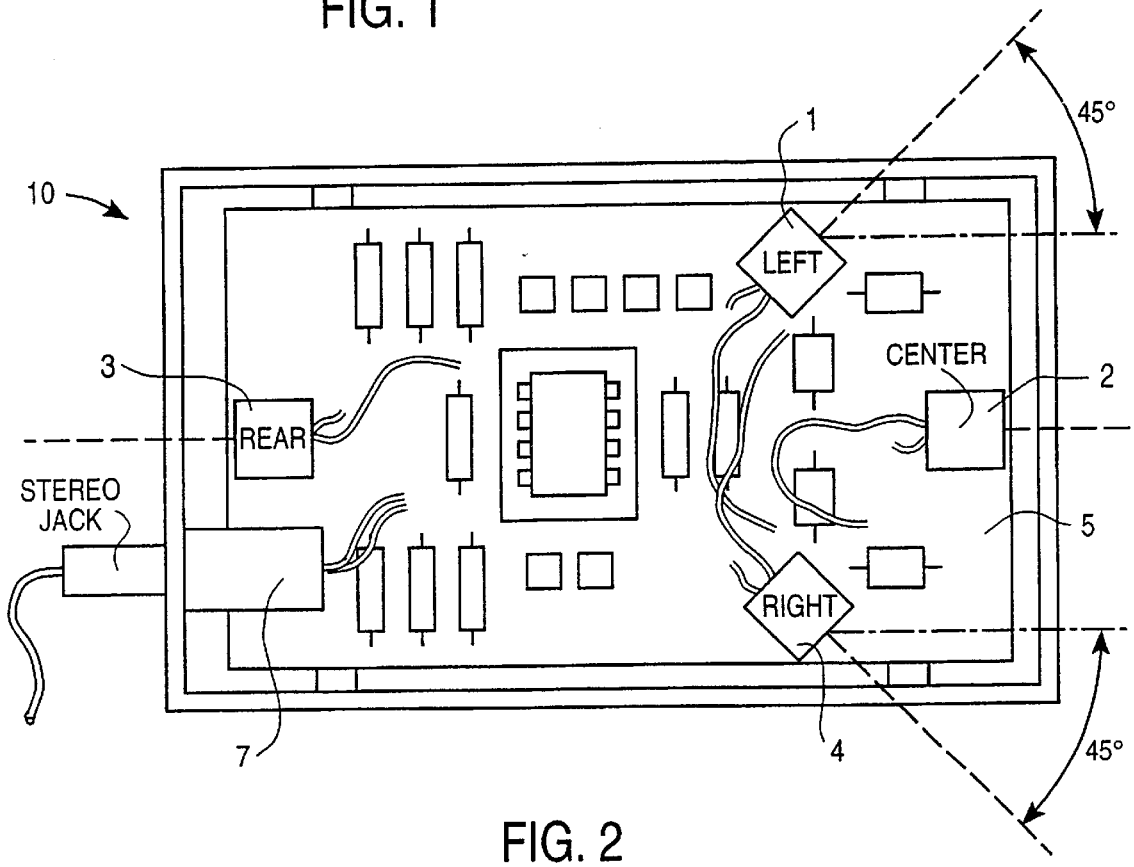
FIG. 2 is plan view of the embodiment of FIG. 1 showing the circuit board, the orientation of the four microphones, and the elements comprising the combining circuit.

FIG. 2 is a plan view of the first preferred embodiment 10. It shows an array of four microphone elements, namely left microphone 1, center microphone 2, rear microphone 3, and right microphone 4, supported on the circuit board 5. The horizontal axial direction of maximum sensitivity of microphone 2 faces center or 0 degrees, that of microphone 1 faces left of center by preferably 45 degrees (plus or minus 10 degrees), that of microphone 4 faces right of center by preferably 45 degrees (plus or minus 10 degrees), and that of microphone 3 faces directly behind center at 180 degrees. The orientation of the microphone elements in this way implements a surround image, i.e., that sound effect or perception which is familiar to the audiences of movies, television, and theater due to the deliberate staging choices made in those fields of entertainment. Note that the microphones need not be mounted in planes that coincide as one—indeed, they may be stacked on top of each other in a vertical column (see the discussion of FIG. 8, below). All that is required is that they be mounted in more-or-less parallel planes with their axial directions of maximum sensitivity radially oriented as stated (when viewed from above, as in FIG. 2).

The above description of the device of FIG. 2, with all reference to the center microphone 2 eliminated, applies to the alternate, three microphone implementation of the current invention shown in FIGS. 10 and 11, discussed below.

Also mounted on said circuit board 5 are the elements comprising the combining circuit (see the discussion of FIGS. 5 and 6, below), and an output jack 7.

Figure 3:
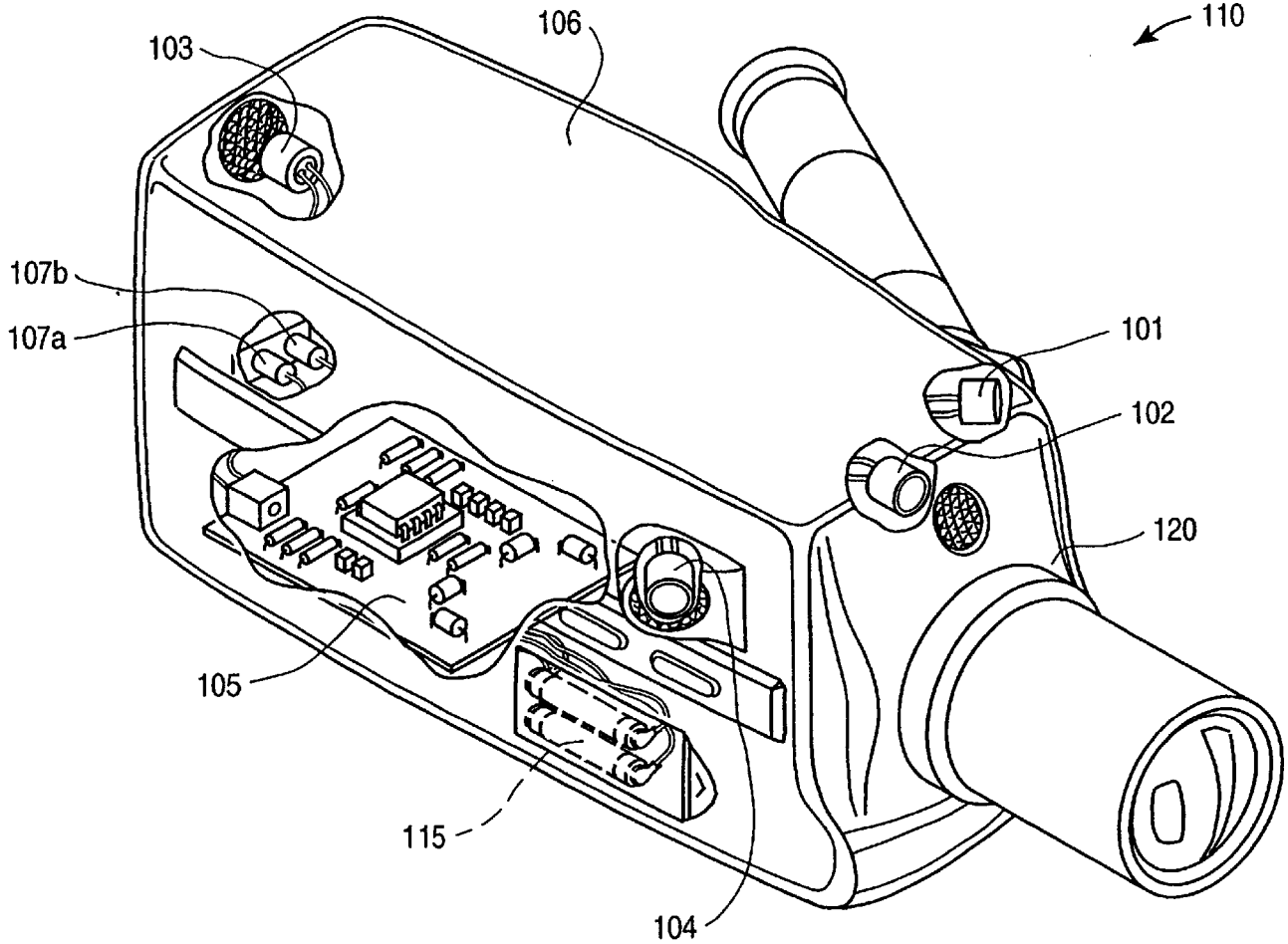
FIG. 3 is a cut-away orthographic view of a second preferred embodiment, which shows the microphone apparatus built into a video recording camera body.

FIG. 3 is a second preferred embodiment of the invention, namely, microphone apparatus 110. It shows the microphone apparatus 110 integrated into a video recording camera or camcorder 120 (the standard video cassette loading bay thereof being omitted in the drawing for clarity). FIG. 3 shows the left 101, center 102, rear 103, and right 104 microphone elements mounted within the camera housing 106 and axially oriented to achieve the same surround image as the embodiment of FIG. 1.

In practice, the circuitry for the combining circuit will be added to an existing circuit board of the camera 120 and will utilize the camera's own internal connections to the recording circuitry and power supply. The circuitry also could utilize a separate circuit board 105 (schematically illustrated in FIG. 3) and power supply 115. Left 107*a* and right 107*b* output jacks (or a single stereo jack) are the only audio output jacks likely to be required by the camera 120.

Figure 4:
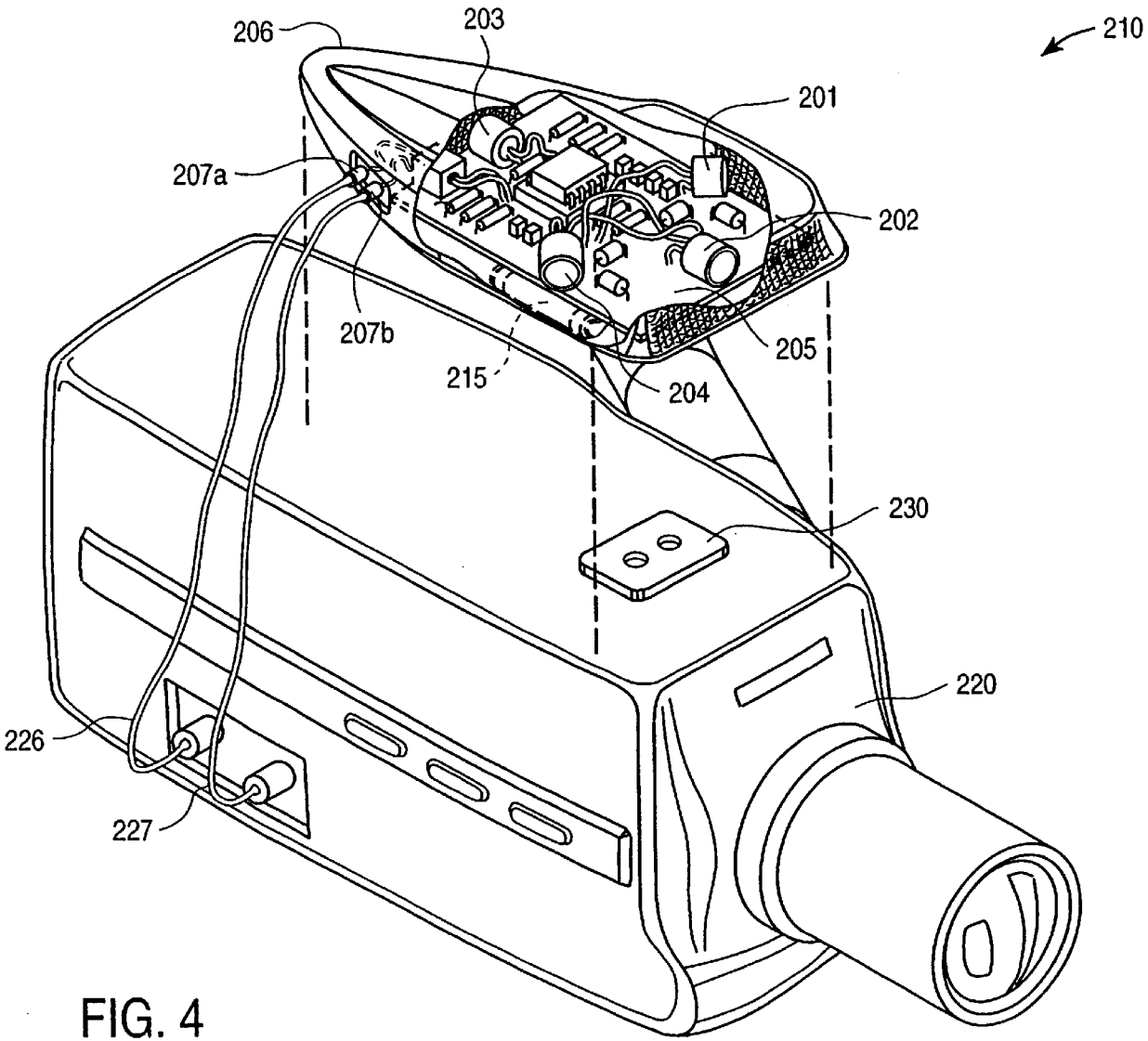
FIG. 4 is a cut-away orthographic view of a third preferred embodiment of the microphone apparatus of this invention, configured for utilization in the internal environment of a video recording camera body.

FIG. 4 illustrates a third preferred embodiment of the invention, namely, microphone apparatus 210 for attaching to a camera or camcorder 220 (the standard video cassette loading bay thereof being omitted in the drawing for clarity). Microphone apparatus 210 is removably mounted on top of the video recording camera 220 through commonly known and widely available foot means for attaching the apparatus externally to a standard accessory mounting shoe 230. A circuit board 205 includes microphone elements left 201, center 202, rear 203 and right 204 mounted within the housing 206 and radially oriented to achieve the surround image, as in the embodiment illustrated in FIG. 1. Output from the microphone apparatus 210 is taken from jacks 207*a* and 207*b* (or a single stereo jack) and is fed through standard audio accessory wires 226 and 227 into the existing microphone jacks of the video recording camera 220. Power may be supplied by a self-contained battery 215 or the device might be powered through the camera's own internal battery-should the shoe 230 have the capability of transferring power. The jacks 207*a* and 207*b* comprise means for attaching the apparatus externally to a video recording camera, along with a standard microphone foot (not illustrated) on the housing 206 adapted for mating with shoe 230.

The circuit schematics and microphone pick-up patterns of the invention will be illustrated with reference to the embodiment illustrated in FIG. 4. However, it is to be understood that said schematics are identical, or equivalent, in the embodiments of FIGS. 1 and 3. Furthermore, all embodiments share similar microphone pick-up patterns.

Figure 5:
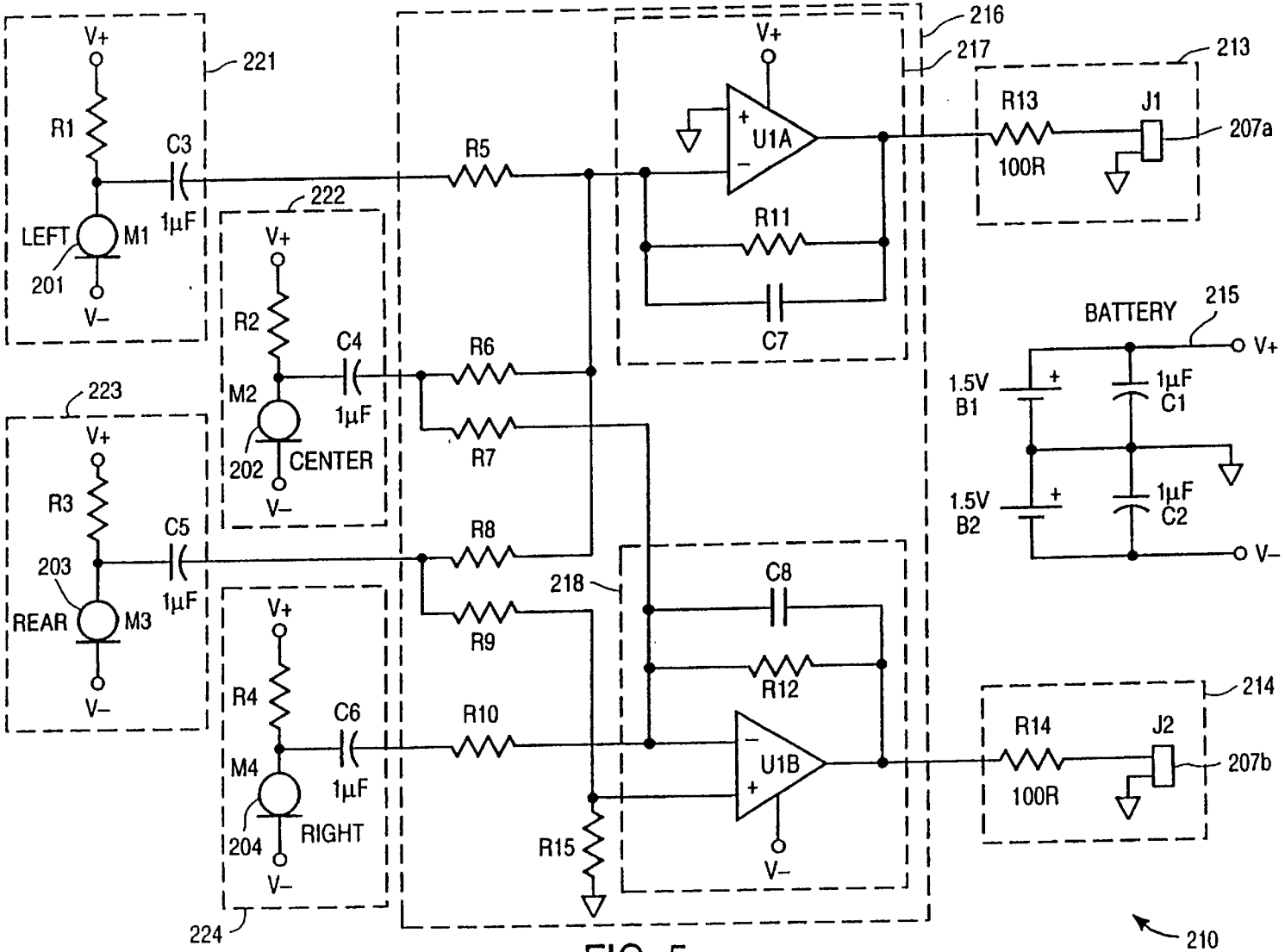
FIG. 5 is a block diagram of the combining circuit, the microphone elements, and the battery of the embodiment of FIG. 4.

FIG. 5 is a schematic circuit diagram of the microphone apparatus 210 of FIG. 4, showing all the elements necessary to achieve correct electrical operation of the presently preferred embodiments of the apparatus. Microphone apparatus 210 includes the four microphone elements, namely, left 201 or M1, center 202 or M2, rear 203 or M3, and right 204 or M4. Also illustrated in standard notation are the circuits 221–224 which drive the microphones, the combining circuit 216 (which will generally be considered herein to include the output buffers 217 and 218, although the latter also can be viewed as separate from the combining circuit), the left and right total output circuits 213 and 214, and the power supply 215.

The same circuitry (not separately illustrated) is used in embodiments 10 and 110 of FIGS. 1 and 3, respectfully.

One aspect of the combining circuit is that the left channel signal does not appear in the right channel, and the right channel signal does not appear in the left channel. This is true because the inputs of the buffer amplifiers are configured as virtual grounds. This is achieved by the use of negative feedback on the buffer amplifiers, which prevents any leakage of signal (that is, the left signal is applied solely to the left buffer circuit; the right signal is applied solely to the right buffer circuit; the left total output signal is generated excluding the right output signal; and the right total output signal is generated excluding the left output signal).

Circuit 221 includes the left microphone element 201, such as the Panasonic WM-55A103 available from DigiKey of Thief River Falls, Minn. Microphone 201 is connected between resistor R1, having a resistance of about 2 Kohms, and the second supply voltage potential V−. Resistor R1 is also connected to the first supply voltage V+ and capacitor C3, which has a capacitance of about 1 F. Capacitor C3, in turn, is connected to resistor R5 of circuit 216, resistor R5 having a resistance of about 10 Kohms. R5 is also connected to the inverting input of op-amp U1A, which is part of circuit 217.

Circuit 222 includes the center microphone element 202, of similar make and model, which is connected between resistor R2, having a resistance of about 2 Kohms, and the second supply voltage potential V−. Resistor R2 is also connected to the first supply voltage V+ and the capacitor C4, which has a capacitance of about 1 $\mu$F. Capacitor C4, in turn, is connected to resistor R6 and R7 of circuit 216 and circuit 216 respectively, resistor R6 and R7 having a resistance of about 15 Kohms. The other end of R6 is connected to the inverting input of op-amp U1A, which is part of circuit 217. The other end of R7 is connected to the inverting input of op-amp U1B, which is part of circuit 218.

Circuit 223 includes the rear microphone element 203, which is connected between resistor R3, having a resistance of about 2 Kohms, and the first supply voltage potential V+. Resistor R3 is also connected to the second supply voltage V− and the capacitor C5, which has a capacitance of about 1 $\mu$F. Capacitor C5, in turn, is connected to resistor R8 and R9 of circuit 216, resistor R8 and R9 having a resistance of about 10 Kohms. The other end of R8 is connected to the inverting input of op-amp U1A. The other end of R9 is connected to the positive input of op-amp U1B.

Circuit 224 includes the right microphone element 204, which is connected between resistor R4, having a resistance of about 2 Kohms, and the second supply voltage potential V−. Resistor R4 is also connected to the first supply voltage V+ and the capacitor C6, which has a capacitance of about 1 $\mu$F. Capacitor C6, in turn, is connected to resistor R10 of circuit 218, resistor R10 having a resistance of about 10 Kohms. The other end of R10 is connected to the inverting input of op-amp U1B.

Buffer circuit 217 includes op-amp U1A, the positive input being connected to circuit ground. The negative input of U1A is connected to resistor R11, having a resistance of about 10 Kohms, and capacitor C7, having a capacitance of about 0.001 $\mu$F. The output of U1A is connected to R11, C7, and resistor R13. R13, having a resistance of about 100 ohms, is part of left total output circuit 213. Resistor R13 is connected to jack 207*a* or J1, also part of circuit 213. Jack 31 is also connected to circuit ground.

Buffer circuit 218 includes op-amp U1B. The negative input of U1B is connected to resistor R12, having a resistance of about 10 Kohms, and capacitor C8, having a capacitance of about 0.001 $\mu$F. The output of U1B is connected to R12, C8, and R14. R14, having a resistance of about 100 ohms, is part of right total output circuit 214. Resistor R14 is connected to jack 207*b* or J2, also part of circuit 214. Jack J2 is also connected to circuit ground. Resistor R15 is connected to the positive input of U1B. The other end of the resistor is connected to ground.

Circuit 215 consists of battery B1, whose positive terminal is connected to the first supply voltage V+ and the positive terminal of C1, having a capacitance of about 1 $\mu$F. The negative terminal of battery B2 is connected to the second supply voltage V− and the negative terminal of C2, having a capacitance of about 1 $\mu$F. The negative terminal of battery B1 and capacitor C1, and the positive terminal of battery B2 and capacitor C2 are all connected to circuit ground.

The above description of the device of FIG. 5, with all reference to the center microphone 202 or M2 eliminated, applies to the alternate, three microphone implementation of the current invention shown in FIGS. 10 and 11, discussed below.

Figure 6:
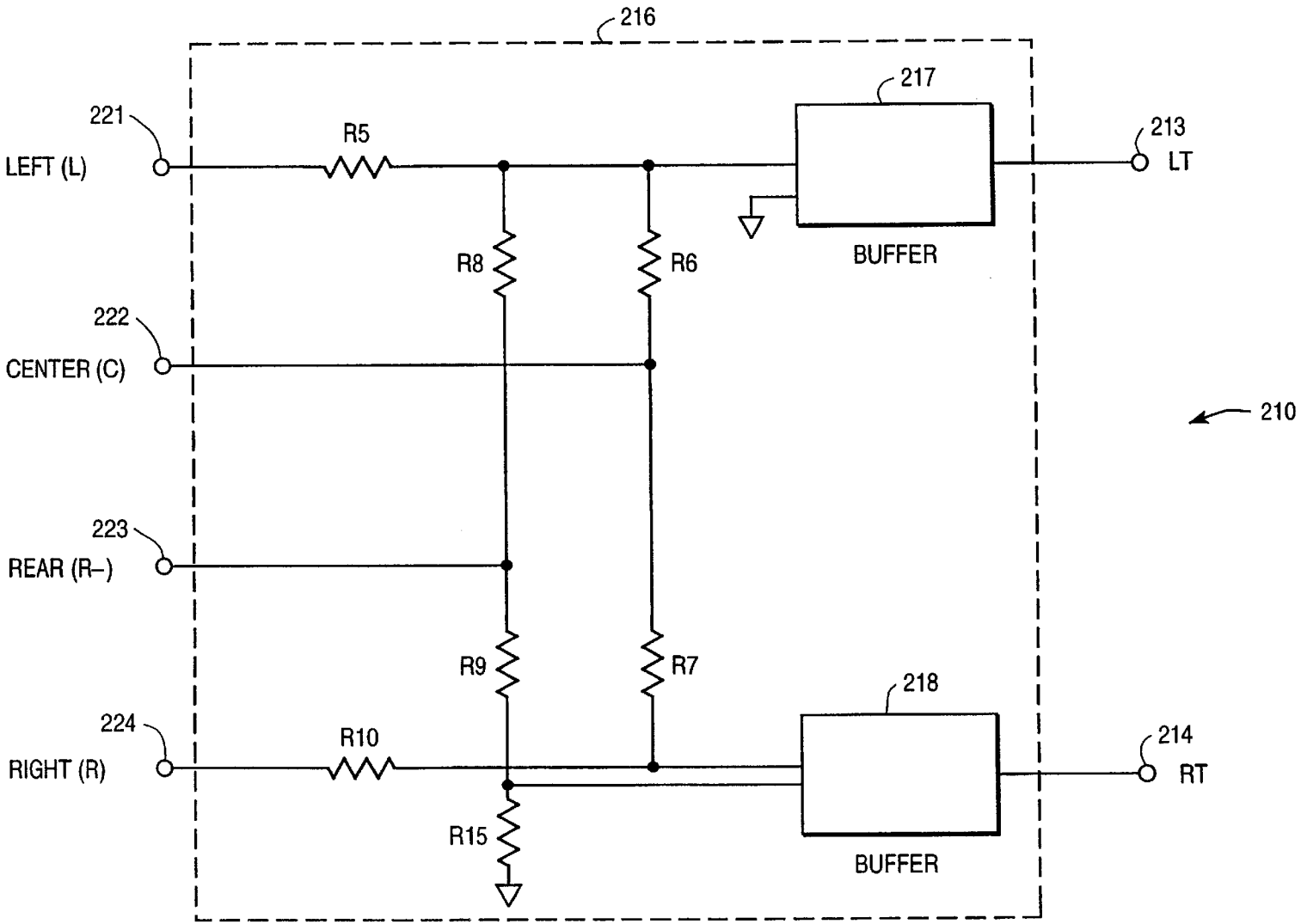
FIG. 6 is a detail block diagram showing how the microphone signals are processed by the combining circuit of FIG. 5.

FIG. 6 is a detail taken from FIG. 5, namely, a schematic circuit diagram of the combining circuit 216 of the microphone apparatus 210 of FIG. 4. For convenience in illustration, the input and output signals of circuits will be referred to by the same numerals as their respective circuits, where the meaning is unambiguous. The output LT 213 (Left Total) is formed by summing the center microphone output signal 222, the left microphone output signal 221, and the rear microphone output signal 223 through resistors R6, R5, and R8, respectively, and then passing the summed signal through the left output buffer 217. The output RT 214 (Right, Total) is formed by summing the center microphone output signal 222, the right microphone output signal 224, through resistors R7, R10, respectively, and then passing the summed signal through the right output buffer 218. The same combining circuit (not separately illustrated) is used in embodiments 10 and 110 of FIGS. 1 and 3, respectively. The rear microphone signal is summed out of phase through the output buffer 218 via resistors R9 and R15.

The above description of FIG. 6, with all reference to the center microphone signal 222 eliminated, applies to the alternate, three microphone implementation of the current invention shown in FIGS. 10 and 11, discussed below.

Figure 7:
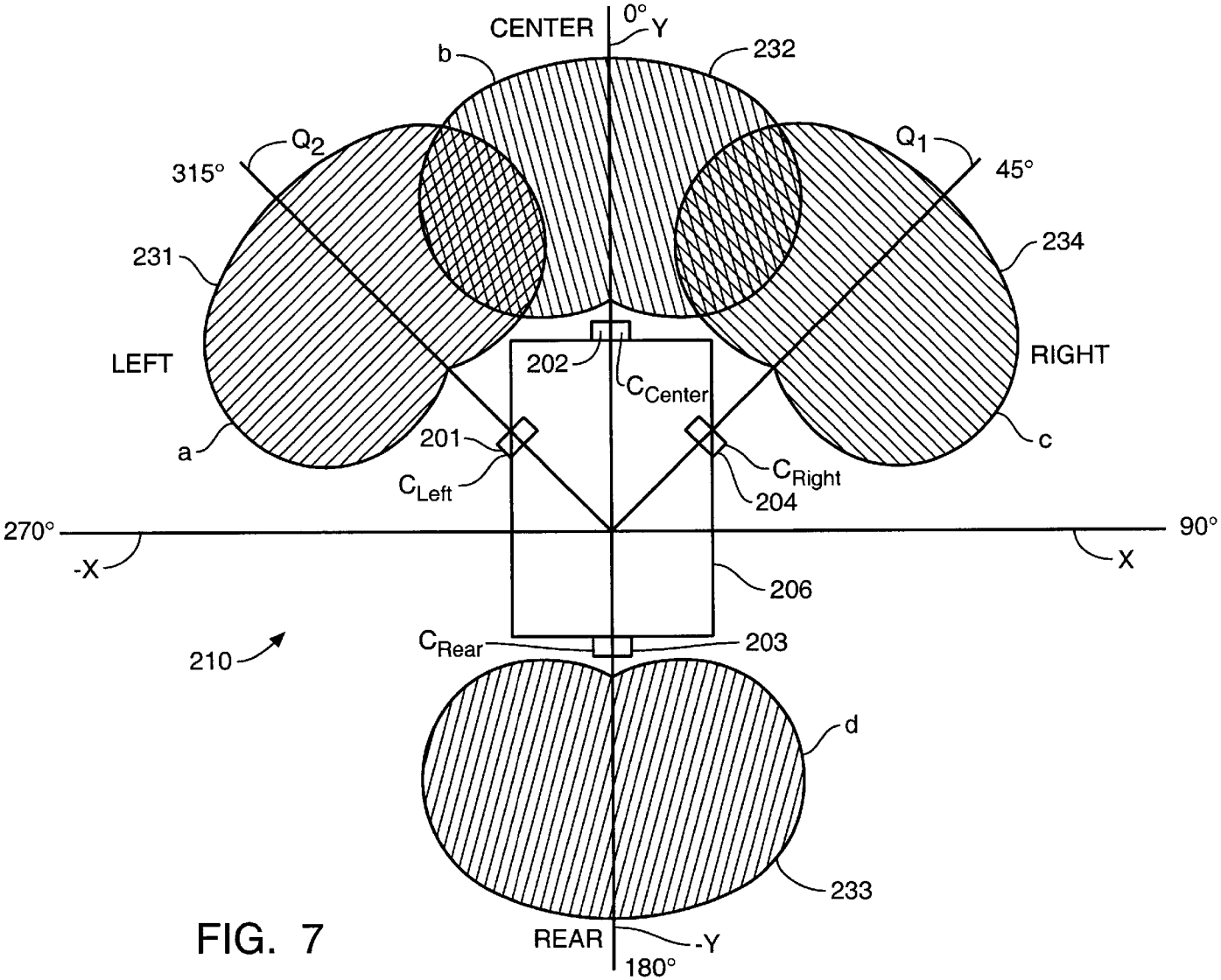
FIG. 7 is a schematic plan view showing the pick-up pattern of the microphone apparatus of FIG. 4.

FIG. 7 is a schematic plan view of the pick-up pattern of microphone apparatus 210, the pick-up pattern of the other embodiments preferably being identical or nearly identical thereto when the same class of microphones is used. FIG. 7 shows the orientation of the four microphone elements 201-204 as arranged on an apparatus housing 206 (schematically viewed) so as to achieve the surround image of this invention. Pick-up pattern 232 shows the sensitivity of the center microphone element 202 to audio information from what is known as center stage. Pick-up pattern 231 shows the sensitivity of the left microphone element 201 to audio information from stage left. Pick-up pattern 234 shows the sensitivity of the right microphone element 204 to audio information from stage right. Pick-up pattern 233 shows the sensitivity of the rear microphone element 203 to ambient or rear audio information. The preferred pick-up pattern of each microphone element is known to be defined by the equation $E=0.5+0.5 \cos \theta$ (where $\theta$ equals angular deviation measured from the axis of maximum sensitivity of each microphone), in the limacon family of patterns, for the microphones of the preferred embodiments. Alternatively, other types of microphones may be used, including combinations of gradient and omnidirectional microphones. Examples of alternate individual microphone element pickup patterns can be found in the patents listed in the table above and elsewhere—for example, in U.S. Pat. No. 4,262,170 and U.S. Pat. No. 4,072,821. The overall pattern of the four microphone elements of the present invention, however, is unique.

The above description of FIG. 7, with all reference to the center microphone element 202 and its pick-up pattern 232 eliminated, applies to the alternate, three microphone implementation of the current invention shown in FIGS. 10 and 11, discussed below.

FIG. 7 can also be used to illustrate an alternate characterization of the invention. Four microphone capsules C(left), C (center), C(right), and C(rear) are designated serially about a common axis, so as to separate the sound field into four regions of a plane. The plane is divided into four quadrant areas by orthogonal axis lines X/-X and Y/-Y having an intersection generally at the center of the plane, with a line Q1 bisecting a first quadrant of the plane, and line Q2 bisecting a second quadrant of the plane. Sound waves from a Q2 direction in the plane excite capsule C(left) to produce signal Ea, sound waves from a Y direction in the plane excite capsule C(center) to produce signal Eb, sound waves from a Q1 direction in the plane excite capsule C(right) to produce signal Ec, and sound waves from a -Y direction in the plane excite capsule C(rear) to produce signal Ed. Translating circuitry provide signals containing information distinguishing between soundwaves from the Q1, Y, Q2, and -Y directions. Signal processing circuitry has input connections to the translating circuitry, and output connections delivering two separate output signals analogous respectively to the Q1, Y, and -Y directions, and the Q2, Y, and -Y directions.

This yields a further alternate characterization of the invention; i.e., signal processing circuitry to effect the following relationships:

EL=K(Ea+Eb+Ed); and

ER=K(Ec+Eb−Eb); where EL is a stereo output signal analogous to sound velocity along the direction of lines Q2, Y, and -Y; ER is a stereo output signal analogous to sound velocity along the direction of lines Q1, Y, and -Y; K is a constant; a, b, c, and d are surround image areas designated serially in rotation about the intersection, and Ea, Eb, Ec, and Ed are electrical output signals from the areas a, b, c, and d, respectively.

Figure 8:
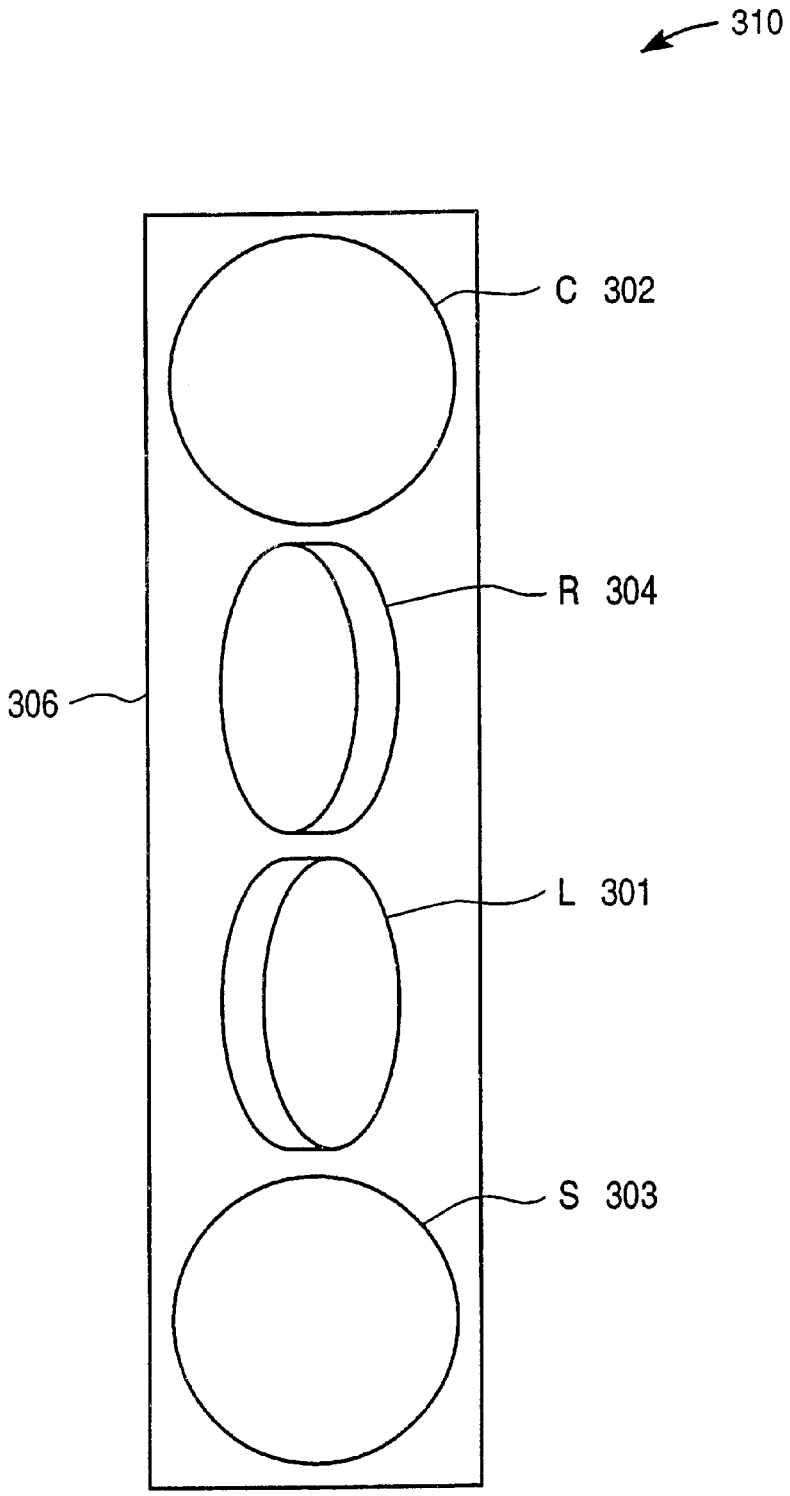
FIG. 8 is a schematic elevation of a fourth preferred embodiment of the microphone apparatus of this invention.

FIG. 8 shows a fourth preferred embodiment of the invention, namely, microphone apparatus 310. A housing 306 includes microphone elements left 301, center 302, rear 303 and right 304 radially oriented to achieve the surround image, as in the embodiment illustrated in FIG. 1. FIG. 8 illustrates in a highly schematic manner that the microphones need not be mounted in a single plane. In microphone apparatus 310 they are stacked on top of each other in a vertical column and oriented in parallel planes. The horizontal axial direction of maximum sensitivity of microphone 302 faces center or 0 degrees, that of microphone 301 faces left of center by preferably 45 degrees (plus or minus 10 degrees), that of microphone 304 faces right of center by preferably 45 degrees (plus or minus 10 degrees), and that of microphone 303 faces directly behind center at 180 degrees.

The above description of FIG. 8, with all reference to the center microphone element 302 eliminated, applies to the alternate, three microphone implementation of the current invention shown in FIGS. 10 and 11, discussed below.

METHOD OF OPERATION

For a functional description of the circuit, reference is made once again to FIG. 5. In circuit 221, resistor R1 provides bias voltage to microphone element M1. Capacitor C3 is an AC coupling capacitor. The descriptions for circuits 224 and 222 are the same as for circuit 221.

Circuit 216 is the combining circuit. Resistors R5, R6, and R8 serve to combine the outputs of the left, center and rear microphones, respectively, into the negative input of U1A, part of circuit 217. Resistors R7, R9, and R10 serve to combine the outputs of the center, rear and right microphones, respectively, into the negative input of U1B, part of circuit 218.

Circuit 217 utilizes op-amp U1A as a buffer amplifier for the combined signals from the left, center and rear microphones. Likewise, Circuit 218 utilizes op-amp U1B as a buffer amplifier for the combined signals from the right, center and rear microphones.

Circuit 213 serves to isolate the output of U1A from capacitive loads using resistor R13, and J1 is the output jack for the left channel. Circuit 214 serves to isolate the output of U1B from capacitive loads using resistor R14, and J2 is the output jack for the right channel.

Circuit 215 serves as the power source for op amps U1A and U1B, and the bias source for the four microphones M1–M4.

Referring again to FIG. 5, a sound generated at stage left travels to the left microphone circuit 221. The signal from the left microphone circuit is then steered to the left buffer 217 by combining circuit 216. From there the signal is sent out through left total output circuit 213.

A sound generated at stage right travels to the right microphone circuit 224. The signal from the right microphone circuit is then steered to the right buffer 218 by combining circuit 216. From there the signal is sent out through right total output circuit 214.

A sound generated at center stage travels to the center microphone circuit 222. The signal from the center microphone circuit is then steered to both the left buffer 217 and the right buffer 218 by combining circuit 216. From there the signal is sent out through total output circuits 213 and 214.

An ambient sound travels to the rear microphone circuit 223. The signal from the rear microphone circuit is then steered to both the left buffer 217 and the right buffer 218 by combining circuit 216. From there the signal is sent out through total output circuits 213 and 214.

The right and left total output signals, which are produced by the right total output circuit 214 and by the left total output circuit 213, respectively, together are a stereo composite signal equivalent to that required by surround decoders. Such surround decoders are commercially available under the product name Kenwood Audio/Video Surround Receiver, Model #107VR from Kenwood USA of Long Beach, Calif.

Figure 9:
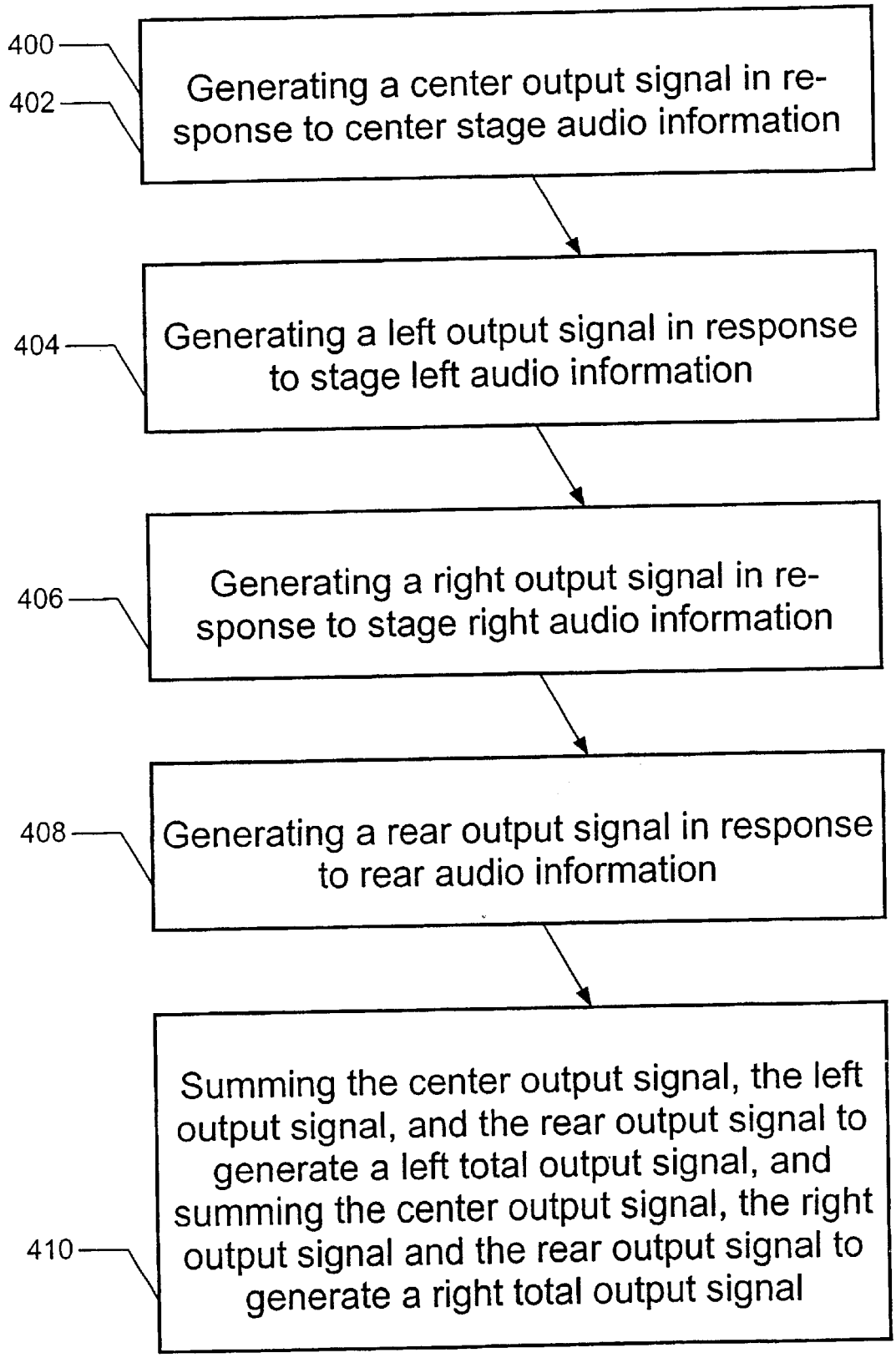
FIG. 9 is a flowchart describing a method embodiment of this invention.

FIG. 9 is a flowchart 400 describing a method embodiment of the present invention. In step 402, a center output signal is generated in response to center stage audio information. In step 404, a left output signal is generated in response to stage left audio information. In step 406, a right output signal is generated in response to stage right audio information. In step 408, a rear output signal is generated in response to rear audio information. In step 410, the center output signal, the left output signal, and the rear output signal are summed to generate a left total output signal, while the center output signal, the right output signal, and the rear output signal are summed to generate a right total output signal. It will be appreciated by those skilled in the art that the order of steps 402, 404, 406, and 408 is not limiting, since those steps typically occur concurrently.

The above description of FIGS. 5 and 9 as to method of operation, with all reference to the center microphone element 202 and its associated circuitry, R2, C4, R6, and R7 eliminated, applies to the alternate, three microphone implementation of the current invention shown in FIGS. 10 and 11, discussed below.

Figure 10:
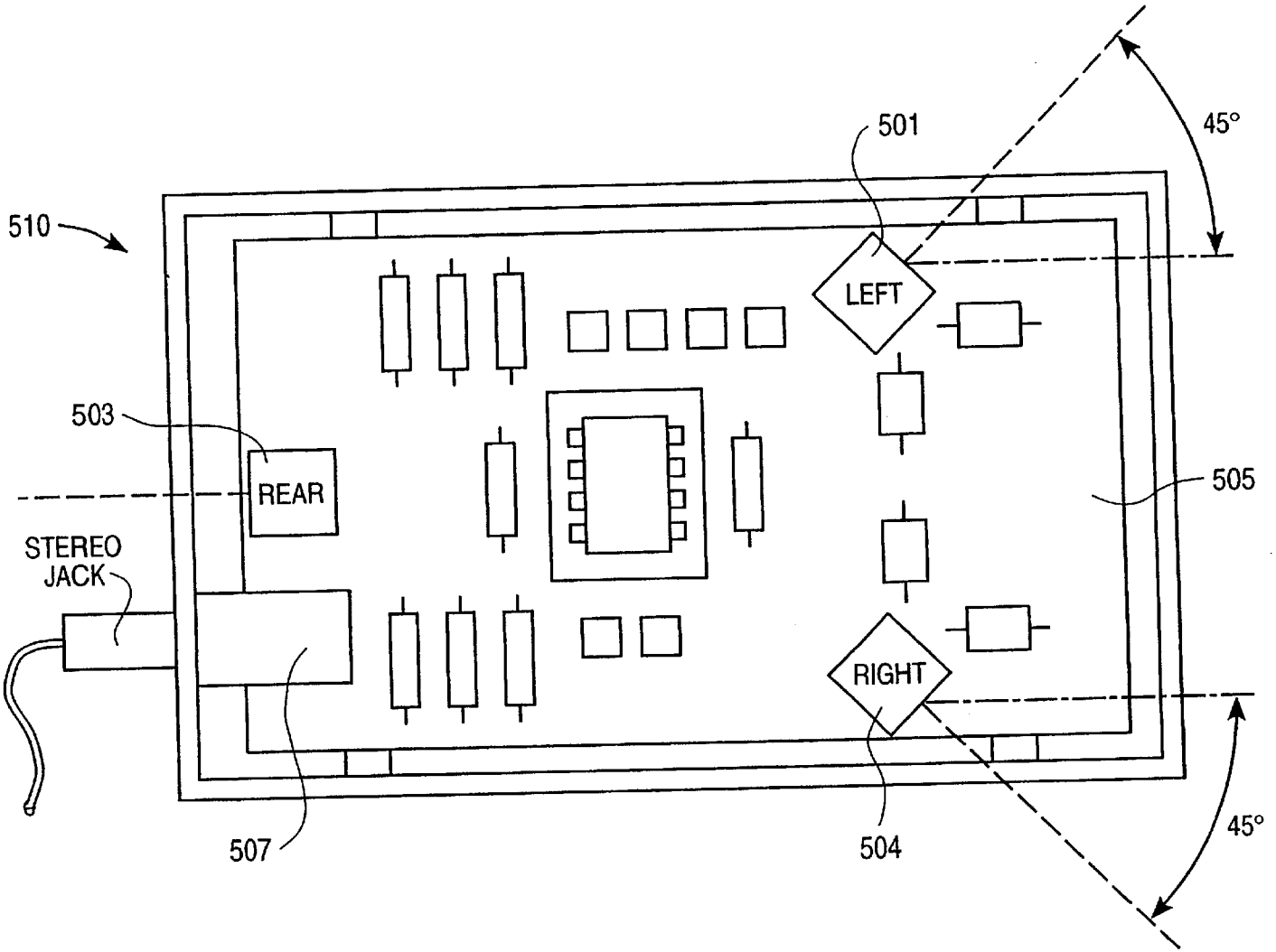
FIG. 10 is a plan view of a fifth preferred embodiment of the microphone apparatus of this invention, showing orientation of just three microphone elements.
Figure 11:
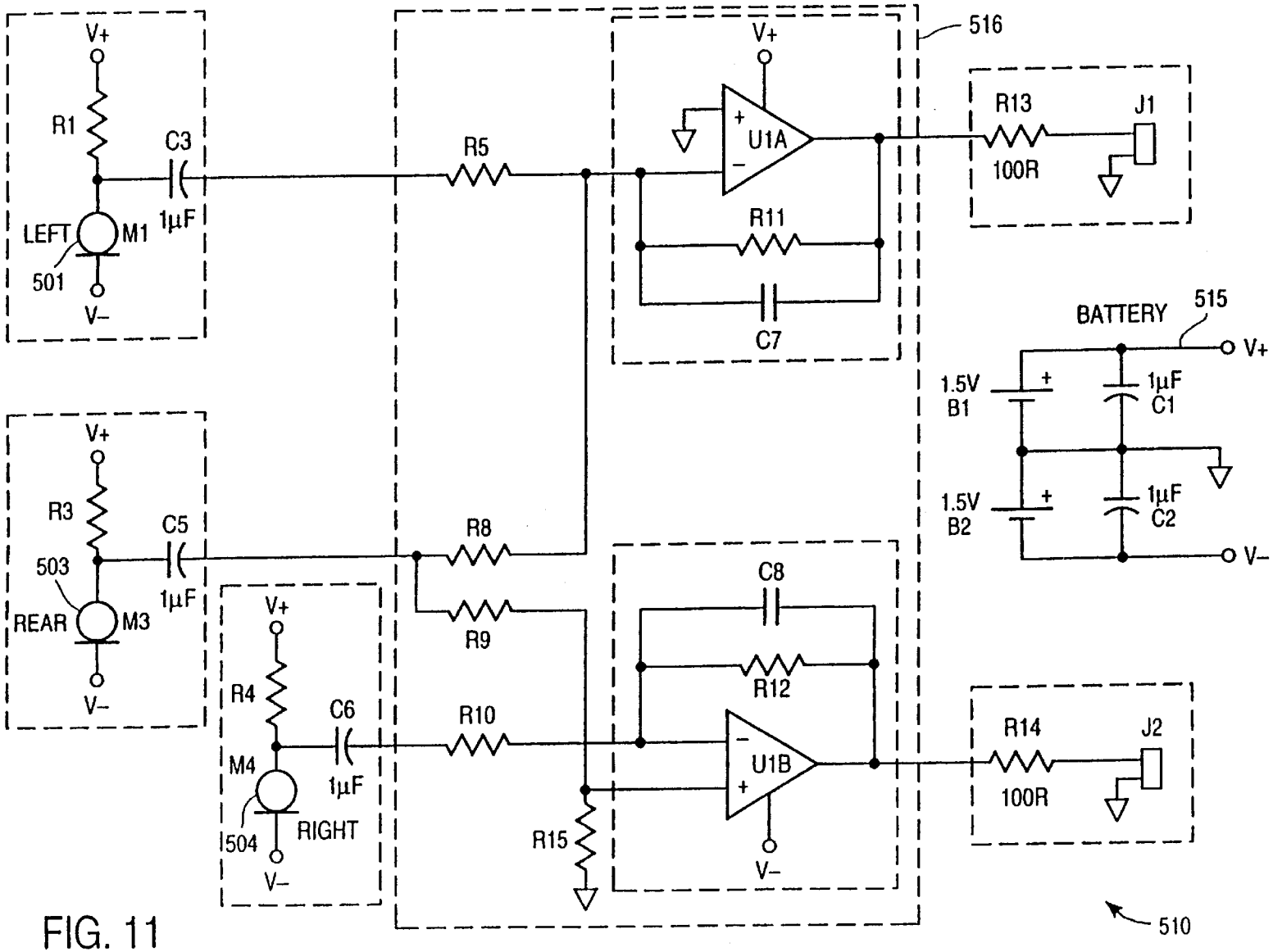
FIG. 11 is a block diagram of the combining circuit, the microphone elements, and the battery of the embodiment of FIG. 10.

An alternative implementation of the present invention is shown in FIGS. 10 and 11, namely, one which uses only three microphone elements. The center channel microphone element is eliminated, and a virtual center channel is present at outputs LT and RT. Stage center information will reach the left and right microphone elements simultaneously. Thus, the sum of left and right will appear equally and in phase on both outputs (hence, in phase monaural and, hence, "center"). No change in combining circuitry is called out.

FIG. 10 is a plan view of the fifth preferred embodiment 510. It shows an array of three microphone elements, namely left microphone 501, rear microphone 503, and right microphone 504, supported on the circuit board 505, and includes jack 507. The horizontal axial direction of maximum sensitivity of microphone 501 faces left of center by preferably 45 degrees (plus or minus 10 degrees), that of microphone 504 faces right of center by preferably 45 degrees (plus or minus 10 degrees—being thus a total of preferably 70 to 110 degrees to the right of the left microphone), and that of microphone 503 faces directly behind center at 180 degrees (being thus 125 to 145 degrees counterclockwise behind the left microphone). The orientation of the microphone elements in this way implements the surround image. The stereo jack comprises means for attaching the apparatus externally to a video recording camera, along with a suitable microphone foot (not illustrated) on the microphone housing adapted for mating with a camera shoe.

FIG. 11 is a block diagram of the combining circuit 516, the microphone elements 501, 503, 504, and the battery 515 of the fifth embodiment of the invention, namely, microphone apparatus 510. FIG. 11 is identical in layout and method of operation to FIG. 5, except that the center microphone element 202 and the center microphone circuit 222 of FIG. 5 are eliminated in this embodiment.

The above disclosure is sufficient to enable one of ordinary skill in the art to practice the invention, and provides the best mode of practicing the invention presently contemplated by the inventors. While there is provided herein a full and complete disclosure of the preferred embodiments of this invention, various modifications, alternative constructions, and equivalents may be employed without departing from the true spirit and scope of the invention. Such changes might involve alternative materials, components, structural arrangements, sizes, operational features or the like.

For example, it may be advantageous to use directional microphones at the left, right and center positions and a single omnidirectional microphone at the rear position.

Furthermore, in practice, the microphone apparatuses 10, 110, 210, 310 and 510 will be greatly miniaturized when compared to the embodiments illustrated, utilizing methods and apparatus well known in the art—such as printed circuit boards, integrated circuits, and the like-so as to reduce the size of, or eliminate as discrete elements, various components shown enlarged herein for purposes of illustration of the invention. For example, in the embodiment shown in FIG. 3, all of the components will be so integrated with the circuitry of the video camera 120 that separate circuit board, wiring, output jacks and power supply likely will not be necessary. However, four microphones always will be needed to achieve the surround image, substantially in the positions and orientations shown.

Therefore, the above description and illustrations should not be construed as limiting the scope of the invention, which is defined by the appended claims.

What is claimed is:

1. A microphone apparatus, including:

a center microphone having a first axial direction of maximum sensitivity in a reference plane, the center microphone producing a center output signal;

a left microphone having a second axial direction of maximum sensitivity, the left microphone fixedly mounted leftward with respect to the center microphone so that the second axial direction is inclined in the reference plane at an angle of substantially 45 degrees with respect to the first axial direction, the left microphone producing a left output signal;

a right microphone having a third axial direction of maximum sensitivity, the right microphone fixedly mounted rightward with respect to the center microphone so that the third axial direction is inclined in the reference plane at an angle of substantially 45 degrees with respect to the first axial direction, the right microphone producing a right output signal;

a rear microphone having a fourth axial direction of maximum sensitivity, the rear microphone fixedly mounted rearward with respect to the center microphone so that the fourth axial direction is inclined in the reference plane at an angle of substantially 180 degrees with respect to the first axial direction, the rear microphone producing a rear output signal;

combining circuit means for summing the center output signal, the left output signal, and the rear output signal into a left total output signal, and for summing the center output signal, the right output signal, and the rear output signal into a right total output signal, wherein the combining circuit means, when summing the center output signal, the left output signal, and the rear output signal into the left total output signal, does not sum the right output signal into said left output signal, and the combining circuit means, when summing the center output signal, the right output signal, and the rear output signal into the right total output signal, does not sum. the left output signal into said right output signal; and at least one battery interconnected with the microphones and all the circuit means.

2. The apparatus of claim 1 further including:

left buffer circuit means for buffering the center output, left output and rear output signals after their summation by the combining circuit means, to form the left total output signal; and right buffer circuit means for buffering the center output, right output and rear output signals after their summation by the combining circuit means, to form the right total output signal.

3. The apparatus of claim 1 further including:

at least one output jack.

4. The apparatus of claim 1 wherein:

each microphone has a pick-up pattern in the limacon family of patterns.

5. The apparatus of claim 1 wherein:

each microphone is of the omnidirectional type.

6. The apparatus of claim 1 wherein:

the right and left total output signals together are a stereo composite signal equivalent to that required by surround decoders.

7. The apparatus of claim 1 wherein:

the rear output signal is reversed in phase with respect to the right and center output signals on the right total output signal.

8. The apparatus of claim 1 further including:

means for attaching the apparatus externally to a video recording camera.

9. The apparatus of claim 1 further including:

a video recording camera body, the apparatus integrated within the video recording camera body.

10. A microphone apparatus, including:

a center microphone having a first axial direction of maximum sensitivity in a reference plane, the center microphone producing a center output signal;

a left microphone having a second axial direction of maximum sensitivity, the left microphone fixedly mounted leftward with respect to the center microphone so that the second axial direction is inclined in the reference plane at an angle of substantially 45 degrees with respect to the first axial direction, the left microphone producing a left output signal;

a right microphone having a third axial direction of maximum sensitivity, the right microphone fixedly mounted rightward with respect to the center microphone so that the third axial direction is inclined in the reference plane at an angle of substantially 45 degrees with respect to the first axial direction, the right microphone producing a right output signal;

a rear microphone having a fourth axial direction of maximum sensitivity, the rear microphone fixedly mounted rearward with respect to the center microphone so that the fourth axial direction is inclined in the reference plane at an angle of substantially 180 degrees with respect to the first axial direction, the rear microphone producing a rear output signal;

combining circuit means for summing the center output signal, the left output signal, and the rear output signal into a left total output signal, and for summing the center output signal, the right output signal, and the rear output signal into a right total output signal, wherein the combining circuit means, when summing the center output signal, the left output signal, and the rear output signal into the left total output signal, does not sum the right output signal into said left output signal, and the combining circuit means, when summing the center output signal, the right output signal, and the rear output signal into the right total output signal, does not sum the left output signal into said right output signal; and at least one output jack.

11. The apparatus of claim 10 further including:

left buffer circuit means for buffering the center output, left output and rear output signals after their summation by the combining circuit means, to form the left total output signal; and right buffer circuit means for buffering the center output, right output and rear output signals after their summation by the combining circuit means, to form the right total output signal.

12. The apparatus of claim 10 further including:

at least battery interconnected with the microphones and all the circuit means.

13. The apparatus of claim 10 wherein:

each microphone has a pick-up pattern in the limacon family of patterns.

14. The apparatus of claim 10 wherein:

each microphone is of the omnidirectional type.

15. The apparatus of claim 10 wherein:

the right and left total output signals together are a stereo composite signal equivalent to that required by surround decoders.

16. The apparatus of claim 10 wherein:

the rear output signal is reversed in phase with respect to the right and center output signals on the right total output signal.

17. The apparatus of claim 10 further including:

means for attaching the apparatus externally to a video recording camera.

18. The apparatus of claim 10 further including:

a video recording camera body, the apparatus integrated within the video recording camera body.

* * * * *